United States Patent [19]

Dolgin

[11] Patent Number: 4,762,678

[45] Date of Patent: Aug. 9, 1988

[54] METHOD OF PREPARING A BULK AMORPHOUS METAL ARTICLE

[75] Inventor: Benjamin P. Dolgin, Glenview, Ill.

[73] Assignee: Allied-Signal Inc., Morristown, N.J.

[21] Appl. No.: 116,604

[22] Filed: Nov. 3, 1987

[51] Int. Cl.[4] ..... B22F 3/24

[52] U.S. Cl. ..... 419/28; 419/32; 419/39; 419/41; 419/43; 419/46; 419/66; 419/67; 419/69

[58] Field of Search ..... 419/32, 39, 41, 43, 419/28, 46, 66, 67, 69

[56] References Cited

U.S. PATENT DOCUMENTS

| | | | |
|---|---|---|---|
| 4,537,624 | 8/1985 | Tenhover et al. | 75/0.5 B |
| 4,537,625 | 8/1985 | Tenhover et al. | 75/0.5 A |
| 4,557,766 | 12/1985 | Tenhover et al. | 148/11.5 P |
| 4,594,104 | 6/1986 | Reybould | 75/243 |
| 4,624,705 | 11/1986 | Jatkar et al. | 419/33 |
| 4,640,816 | 2/1987 | Atzmon et al. | 419/33 |
| 4,710,236 | 12/1987 | Schultz | 419/33 |

OTHER PUBLICATIONS

C. C. Koch et al., *Appl. Phys. Lett.,* 43, 1017 (1983).

P. S. Gilman and J. S. Benjamin, "Mechanical Alloying:, *Ann. Rev. Mater. Sci.,* vol. 13, 279-300 (1983).

B. P. Dolgin, M. A. Vanek, T. McGory and D. J. Ham, *J. of Non Crystalline Solids,* 87, 281-289 (1986).

B. P. Dolgin, *Mat. Res. Soc. Symp.,* vol. 80, 69 (1987).

*Primary Examiner*—Stephen J. Lechert, Jr.

*Attorney, Agent, or Firm*—Thomas K. McBride; Eugene I. Snyder; Frank S. Molinaro

[57] ABSTRACT

The present invention provides a method of producing a bulk amorphous metal alloy article. The method involves mechanically alloying a matrix metal and a fast diffuser element into a powder mixture consisting of particles having a modulated structure and whereby the powder is at least 50% but less than 100% amorphous. The resultant powder mixture is formed into a bulk amorphous metal alloy article by standard forming methods such as cold or hot-pressing. This bulk article can be further processed into a bulk crystalline metal alloy article by heating at a temperature above the glass transition temperature of the amorphous metal alloy article.

10 Claims, 1 Drawing Sheet

METHOD OF PREPARING A BULK AMORPHOUS METAL ARTICLE

BACKGROUND OF THE INVENTION

A number of crystalline metal alloy materials are generally brittle and hard to machine. Examples of such materials are metal alloys which are permanent magnets. Because of the hardness and brittleness of these materials, the machining of these materials into small magnets which can be fitted into magnetic circuits is very expensive. therefore, a specific need exists for a more economical method of forming magnetic materials into a desired shape.

The instant invention cures this problem by preparing a bulk amorphous metal alloy article which is easily machinable and which can be recrystallized to give the appropriate magnetic material. Amorphous materials are well known in the art and are produced in a number of ways. One such method disclosed in U.S. Pat. Nos. 4,537,624 and 4,537,625 involves the thermal or chemical decomposition of a precursor compound to give an amorphous material. Another method of forming an amorphous material is through the rapid quenching ($10^{6}$° C./second) of a molten material. See, for example, U.S. Pat. No. 4,594,104 and references therein. A further method of producing an amorphous material is through mechanical alloying. C. C. Koch et al. *Appl. Phys. Lett,* 43, 1017 (1983). Mechanical alloying is a physical process which takes place during high energy ball milling. More specifically, mechanical alloying is characterized by the repeated welding, fracturing and rewelding of powder particles. Mechanical Alloying can produce an amorphous powder. For a more detailed explanation see P. S. Gilman and J. S. Benjamin, "Mechanical Alloying", *Ann. Rev. Mater. Sci.,* Vol. 13, 279-300 (1983).

These amorphous materials usually cannot be formed into a bulk amorphous metal alloy article by ordinary forming methods (i.e. ordinary with respect to crystalline material) such as cold or hot-pressing. By bulk or consolidated article is meant an article which has high strength (not easily deformed), integrity, hardness, etc. However, some of these amorphous materials can be formed into a bulk amorphous metal alloy article by more severe methods such as high speed compaction. For a description of the high speed compaction process, see U.S. Pat. No. 4,594,104. Examples which fall into the latter category include NiTi, SmCo, NiZr, NiHf, and CuZr.

The prior art additionally discloses two specialized methods of forming bulk amorphous metal alloy articles. First, U.S. Pat. No. 4,557,766 discloses that an intimate mixture (which is crystalline) of the components of the metal alloy is formed by chemically reducing compounds of the desired components. The intimate mixture can be formed into a bulk amorphous metal alloy article by standard methods such as hot-pressing and then heated to induce the amorphous state. Second, U.S. Pat. No. 4,640,816 discloses a method of cold-working the precursors into a thin sheet or film and then heating the sheet to induce the amorphous state. It is also necessary that one of the precursors be in the form of a film, foil, sheet, etc. Thus, this method gives very limited shapes of the amorphous metal alloy.

In marked contrast to the prior art, the present invention provides a simple method of forming a bulk amorphous metal alloy article from at least one matrix metal and at least one element which is a fast diffuser in the matrix meal (hereinafter fast diffuser element). Unlike the method described in U.S. Pat. No. 4,594,104, which uses an elaborate system to precipitate an intimate mixture of the components of the metal alloy, the instant invention starts with simple crystalline powders or flakes of the desired components which are mechanically alloyed into a substantially amorphous intimate powder mixture. By substantially amorphous is meant that the powder mixture is at least 50% but less than 100% amorphous.

The prior art does not disclose nor suggest that it would be advantageous to mechanically alloy a matrix metal and a crystalline diffuser element to a point that some degree of crystallinity remains. It is applicant who has surprisingly discovered that the presence of a crystalline component in a mechanically alloyed powder mixture allows one to form bulk amorphous metal alloy articles using standard forming methods such as cold-rolling or hot-pressing. Applicant has also discovered, absent any teaching in the prior art, that in order to form bulk amorphous metal alloy articles, each particle of the powder mixture must have a modulated structure. By modulated structure is meant a concentric gradient of the respective components of the particle.

In summary, this invention provides a simple method of forming a bulk amorphous metal alloy article by routine methods such as cold or hot-pressing. This presents a ignificant advance in the art by forming a bulk amorphous metal alloy article without resorting to such costly and limited (i.e. shape limited) methods as high speed compaction.

SUMMARY OF THE INVENTION

It is a broad objective of this invention to provide a method of producing a bulk amorphous metal article comprising:

(a) mechanically alloying at least one crystalline matrix metal and at least one crystalline element which is a fast diffuser in the matrix metal into a powder mixture consisting of particles having a modulated structure, whereby the powder mixture is at least 50% but less than 100% amorphous;

(b) forming the powder mixture into a bulk amorphous metal alloy article, having a density of at least 80% of its theoretical density, at a pressure above about 5,000 atmospheres and at a temperature from about 25° C. to below the glass transition temperature of the powder mixture, and recovering the bulk amorphous metal alloy article.

It is another embodiment of this invention of subsequently heat treat the bulk amorphous metal alloy article at a temperature above the forming temperature of step (b) above, but below the glass transition temperature of the bulk amorphous metal alloy article, thereby relieving any residual stress and any concentric gradients.

It is another embodiment of this invention to subsequently heat treat said bulk amorphous metal alloy article above its glass transition temperature for a time sufficient to provide a bulk crystalline metal alloy article.

In a specific embodiment of this invention a cobalt powder and a titanium powder are mechanically alloyed by milling for 4 hours to give a powder mixture consisting of particles having a modulated structure and which powder is at least 50% amorphous. Hot pressing of the powder mixture at a temperature of about 350° C. and a pressure of 10,000 atmospheres diffuses the cobalt into the titanium effecting alloying of the metals and forming an amorphous cobalt-titanium disc having a density of 95% of its theoretical density. Additionally, the amorphous cobalt-titanium alloy disc may be heated above 550° C. for about 2 hours to provide a crystalline cobalt-titanium alloy disc.

Other objects and embodiments of this invention will become apparent in the following detailed description.

DETAILED DESCRIPTION OF THE INVENTION

Figure 1A:
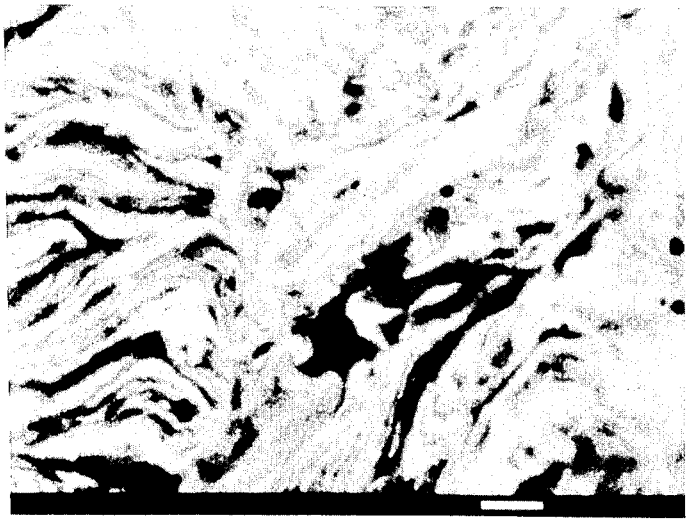
FIG. 1*a* shows a scanning electron micrograph of a $Ni_{0.5}Ti_{0.5}$ powder which has been mechanically alloyed for 2 hours.

As heretofore stated, this invention relates to a method of producing a bulk amorphous metal alloy article and a bulk crystalline metal alloy article. The use of the phrase "amorphous metal alloy" herein refers to an amorphous metal-containing alloy that may also contain non-metallic elements. Illustrative of these non-metallic elements are boron, carbon, silicon, etc. An essential feature of the invention is the use of mechanical alloying to produce a powder which is an intimate mixture of the components of the metal alloy. The powder consists of particles having a modulated structure and said powder being at least 50% amorphous but less than 100% amorphous. These properties allow the powder mixture to be formed into a bulk amorphous metal alloy article using standard forming techniques such as hot-pressing.

Accordingly, one necessary component of the present invention is at least one crystalline matrix metal. Illustrative of the matrix metals which can be used in the present invention are: scandium, yttrium, titanium, zirconium, hafnium, vanadium, niobium, tantalum, the lanthanides and the actinides. The matrix metal can be used in any particulate form such as flakes, powders, granules, etc.

A second necessary component of the present invention is at least one crystalline element which is a fast diffuser in the crystalline matrix element. By fast diffuser is meant an element which is capable of diffusing into the matrix metal at a rate greater than 2 or more orders of magnitude than the self-diffusion rate of the matrix metal. Examples of elements which are fast diffusers in the matrix elements named above include but are not limited to vanadium, chromium, manganese, iron, cobalt, nickel, copper, zinc, boron, carbon, silicon and gold. Again these elements can be used in any particulate form such as flakes, powders, granules, etc.

Generally, the matrix metals and fast diffuser elements can be combined to give a bulk amorphous metal alloy article having the general formula $A_{1-x}B_x$. Where A is at least one matrix metal, B is at least one fast diffuser element and x ranges from about 0.1 to about 0.9. Included in this formulation are binary, ternary and higher order amorphous metal alloys.

The first step in preparing a bulk amorphous metal alloy article is to mechanically alloy the desired matrix metal(s) and fast diffuser element(s). As stated above, mechanical alloying is a physical process which produces metal powders with controlled microstructures by the repeated welding, fracturing and rewelding of powder particles. One way to achieve mechanical alloying is through the use of a high energy mill. Examples of high energy mills are Szegvari attritor grinding mills and vibratory mills, e.g. Spex Shaker Mill which is manufactured by the Spex Co. For further details the reader is referred to: P. S. Gilman and J. S. Benjamin, "Mechanical Alloying", *Ann. Rev. Mater. Sci.*, Vol. 13, 279–300 (1983).

Thus, using a Spex mill as an example, the appropriate amounts of the desired matrix metal(s) and fast diffuser element(s) may be placed in a stainless steel vial containing stainless steel balls. The atomic ratio of matrix metal(s) to fast diffuser element(s) is the same as that of the final bulk amorphous metal alloy article. For example, if the formula of the final product is AB then the atomic ratio of matrix metal to fast diffuser element is 1:1. Additionally, the amount of steel balls in the grinding vial will vary, but it is preferred that the weight ratio of steel balls to powder (matrix metal plus fast diffuser metal) be about 1:3 to about 10:1.

The grinding can be carried out with the dry metals or a lubricant may be added to minimize adherence of the fine powder which is formed to the walls of the vial and to itself, thus controlling the welding aspect of mechanical alloying. If a lubricant is used, it may be chosen from the group including but not limited to alkyl or aryl hydrocarbons. Examples of these lubricants are toluene, hexane, pentane, xylene etc. The amount of lubricant to be used varies but is usually in the range of about 1 to about 25 weight percent of the total weight of material to be mechanically alloyed.

The amount of time required to produce an intimate powder mixture which is substantially amorphous by mechanical alloying depends on the desired matrix metals and fast diffuser elements, the presence of a lubricant and the weight ratio of balls to powder. Therefore, depending on these parameters, a grinding time in the range of 15 minutes to about 500 hours is sufficient to produce a substantially amorphous powder mixture. The extent of the phase change from crystalline to amorphous can be monitored by x-ray diffraction analysis of the powder mixture and mechanical alloying stopped when the powder is at least 50% amorphous but less than 100% amorphous. It is critical that mechanical alloying be stopped before the powder mixture becomes 100% amorphous. It has been determined that the powder mixture must be partly crystalline in order for the powder mixture to be formed into a bulk amorphous metal alloy article by simple forming methods such as hot-pressing. If the powder mixture is 100% amorphous, then severe forming methods such as high speed compaction must be used to form a bulk amorphous metal alloy article.

Figure 1B:
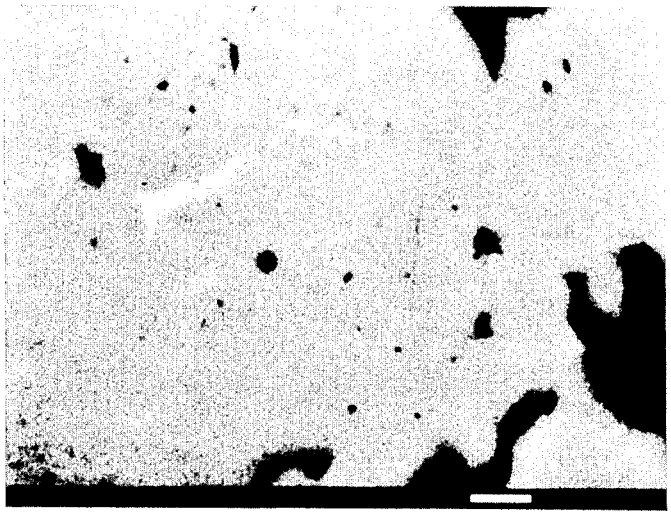
FIG. 1*b* shows a scanning electron micrograph of a $Ni_{0.5}Ti_{0.5}$ powder which has been mechanically alloyed for 16 hours.

An additional necessary feature of the substantially amorphous powder mixture produced by mechanical alloying is that each particle of the power have a modulated structure. By modulated structure is meant that there exists a concentration gradient of the matrix metal(s) and fast diffuser element(s) throughout each particle. This modulated structure is exemplified in FIG. 1. FIG. 1 shows Scanning Electron Microscope (SEM) photographs of a $Ni_{0.5}Ti_{0.5}$ particle from a mechanically alloyed powder mixture. The bright areas in the photograph correspond to nickel and the darker areas correspond to titanium. FIG. 1*a* shows distinct layers of lamella of nickel and titanium. The marker in the lower right hand portion of the photographs represents 1.0 micron. As mechanical alloying progresses these layers (which are less than 1.0 micron thick) disappear, but the particle still shows a concentration gradient of nickel and titanium (see FIG. 1*b*). Thus it is essential to carry out mechanical alloying for a time sufficient to produce a modulated structure finer than that shown in FIG. 1*a*, but not necessarily as fine as the structure shown in FIG. 1*b*.

Once the substantially amorphous powder mixture is formed by mechanical alloying, it can be formed into a bulk amorphous metal alloy article provided the powder mixture has a modulated structure. This step can be accomplished by a number of known processes such as extrusion, hot pressing and hot rolling. The use of standard metal forming processes is one of he advantages of the present invention. The advantage of using standard processes such as extrusion, hot pressing, etc. is that various article shapes can be obtained using these processes whereas the types of shapes which can be obtained using methods such as high speed compaction are very limited. An additional advantage to the present invention is that the desired article can be formed in the receptacle of the bulk article. For example, the holding magnets for a stepping motor can be formed in situ by packing the slots which hold the magnets with the desired amorphous powder and forming in place. Similarly the cutting edge of a metal cutting tool can be formed in situ.

One condition which is necessary to form a bulk amorphous metal alloy article from a substantially amorphous powder mixture is a pressure sufficient to drive the powder particles together. The minimum amount of pressure required to drive the particles together can vary considerably depending on the desired components of the powder mixture, but usually a pressure greater than 5,000 atmospheres is sufficient. When such pressures are applied, diffusion of the fast diffuser element into the matrix metal occurs, thereby bonding and alloying the matrix metal and fast diffuser element. This diffusion occurs at room temperature, but usually the rate is slow. Therefore, for convenience the temperature is raised to increase the diffusion rate of the fast diffuser element into the matrix metal. However, the temperature must be below the glass transition temperature so that crystallization does not occur before diffusion has occurred. Thus, it is convenient to heat the matrix material and the fast diffuser element to a temperature from about 25° C. to below the glass transition temperature (Tg) of the powder mixture and preferably from about 25° C. to below 0.9 Tg. For example, the glass transition temperature for $Ni_{0.5}Ti_{0.5}$ is approximately 510° C., for CoTi is approximately 500° C., and for FeTi it is approximately 490° C. The resultant bulk amorphous metal alloy article can be machined using standard metal machining tools into whatever shape is desired.

Once the bulk amorphous metal alloy article is formed, it is desirable to heat treat the bulk amorphous metal alloy article in order to ensure that diffusion has been completed, to relieve any stress, and to eliminate any concentration gradients. This heat treatment is normally carried out at a temperature higher than the forming temperature but less than the glass transition temperature, and should be carried out for about 30 to about 300 minutes. The bulk amorphous metal alloy articles produced by the instant invention can be used in a variety of applications such as low temperature welding alloys, magnetic bubble memories, high field conducting devices, soft magnetic materials for power transformer cores, etc.

Additionally, the bulk amorphous metal alloy article that has been formed into the desired shape can be further processed to provide a bulk crystalline metal alloy article. This is accomplished by heating the bulk amorphous metal alloy article above its glass transition temperature. Although crystallization occurs almost instantaneously, it is desirable to heat the bulk amorphous metal alloy article at said temperature for a period of time of about 5 minutes to about 5 hours. This ensures that extensive grain growth has occurred and increases the hardness and toughness of the bulk crystalline metal alloy article. Thus, for example, if a CoTi bulk crystalline metal alloy article is desired, heating a CoTi bulk amorphous metal alloy article at 600° C. for about 1 hour produces a bulk crystalline metal alloy article. These bulk crystalline metal alloy articles have a variety of applications including stepping motor magnets, cutting edge of metal cutting tools, etc.

In order to more fully illustrate the advantages to be derived from the instant invention, the following examples are provided. It is to be understood that the examples are by way of illustration only and are not intended as an undue limitation on the broad scope of the invention as set forth in the appended claims.

EXAMPLE I

Two substantially amorphous $Ni_{0.5}Ti_{0.5}$ powder samples were prepared by placing 13.766 grams of a nickel powder (99.6% Ni) and 11.234 grams of a titanium powder (99.9% Ti) into a stainless steel grinding vial with 65 g of stainless steel balls having a diameter of 12 mm. The nickel powder had particles smaller than 325 mesh (44 microns) while the titanium powder had particles smaller than 100 mesh (150 microns). All mixing and handling of the powders were done in a glove box purged with purified nitrogen. The powder samples were milled for 2 or 16 hours and then removed from the vial.

A portion of the 2-hour and 16-hour mechanically alloyed powders were analyzed by scanning electron microscopy (SEM) and x-ray diffraction. FIGS. 1*a* and 1*b* present backscattered SEM photographs of a $Ni_{0.5}Ti_{0.5}$ particle from a powder mixture mechanically alloyed for 2 and 16 hours, respectively. The bright area in the photograph correspond to nickel and the darker areas correspond to titanium. FIG. 1*a* shows distinct layers or lamella of nickel and titanium, while FIG. 1*b* does not show distinct layers but still shows a concentration gradient. The powder mixture which was milled for 16 hours was designated Sample A.

EXAMPLE II

Sample A was formed into an amorphous $Ni_{0.5}Ti_{0.5}$ alloy disc by hot pressing at 350° C. and 10,000 atmospheres for 2 hours. The resultant disc was heat treated at 450° C. for 2 hours to give a crystalline $Ni_{0.5}$ $Ti_{0.5}$ alloy disc.

EXAMPLE III

An amorphous SmCo powder was prepared by placing 5.631 grams of a cobalt powder (99.3% Co), 14.369 grams of a samarium powder (99.9% Sm), and 5 ml of toluene into a stainless steel grinding vial with 65 g of stainless steel balls having a diameter of 10 mm. The cobalt powder had particles smaller than 325 mesh (44 microns) while the samarium powder has particles smaller than 40 mesh (150 microns). All mixing and handling of the powders were done in a glove box purged with purified nitrogen. The powders were milled for 4 hours and then removed from the vial. The resultant powder was formed into an amorphous SmCo alloy disc by hot pressing at 350° C. and 10,000 atmospheres for 2 hours. The resultant disc was heat treated at 450° C. for 2 hours to give a crystalline SmCo alloy disc.

I claim as my invention:

1. A method for producing a bulk amorphous metal alloy article comprising:

(a) mechanically alloying at least one crystalline matrix metal and at least one crystalline element which is a fast diffuser in the matrix metal into a powder mixture consisting of particles having a modulated structure, whereby the powder mixture is at least 50% but less than 100% amorphous; and (b) forming the powder mixture into a bulk amorphous metal alloy article, having a density of at least 80% of its theoretical density, at a pressure above about 5,000 atmospheres and at a temperature from abot 25° C. to below the glass transition temperature of the powder mixture, and recovering the bulk amorphous metal alloy article.

2. The method of claim 1 further characterized in that said bulk amorphous metal alloy article is subsequently heat treated at a temperature above the forming temperature of claim 1 but below the glass transition temperature of said article.

3. The method of claim 1 further characterized in that said bulk amorphous metal alloy article is subsequently heated at a temperature above the glass transition temperature of said article for a period of time of about 5 minutes to about 5 hours to provide a bulk crystalline metal alloy article.

4. The method of claim 1 where said matrix metal is selected from the group consisting of scandium, yttrium, titanium, zirconium, hafnium, vanadium, niobium, tantalum, the lanthanides and the actinides.

5. The method of claim 1 where said fast diffuser element is selected from the group consisting of vanadium, chromium, manganese, iron, cobalt, nickel, copper, zinc, boron, carbon, silicon and gold.

6. The method of claim 1 where the forming is accomplished by extruding the powder mixture through an extrusion die.

7. The powder of claim 1 where the forming is accomplished by hot pressing the powder mixture.

8. The method of claim 1 where the forming is accomplished by hot rolling the powder mixture.

9. The method of claim 1 wherein the forming takes place in a receptacle of a device in which the bulk amorphous metal alloy article of claim 1 is to be used.

10. The method of claim 1 where said mechanical alloying is carried out for a time in the range of about 15 minutes to about 500 hours.

* * * * *